US006217461B1

(12) United States Patent
Galy

(10) Patent No.: US 6,217,461 B1
(45) Date of Patent: Apr. 17, 2001

(54) GOLF CLUB HEAD

(75) Inventor: Philippe Galy, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 09/324,742

(22) Filed: Jun. 3, 1999

Related U.S. Application Data

(63) Continuation of application No. 09/027,565, filed on Feb. 23, 1998, now Pat. No. 5,971,867, which is a continuation of application No. 08/640,340, filed on Apr. 30, 1996, now Pat. No. 5,720,674.

(51) Int. Cl.[7] ..... A63B 53/04

(52) U.S. Cl. ..... 473/328; 473/334; 473/349; 473/345

(58) Field of Search ..... 473/324, 349, 473/344, 345, 346, 334, 335, 338, 256, 328; D21/733

(56) References Cited

U.S. PATENT DOCUMENTS

| | | | |
|---|---|---|---|
| 1,349,806 | * | 8/1920 | Booth . |
| 1,968,092 | | 7/1934 | Oldham . |
| 3,220,733 | | 11/1965 | Saleeby . |
| 3,941,390 | * | 3/1976 | Hussey . |
| 4,852,880 | | 8/1989 | Kobayashi . |
| 4,872,685 | | 10/1989 | Sun . |
| 5,207,428 | * | 5/1993 | Aizawa . |
| 5,273,283 | * | 12/1993 | Bowland . |
| 5,421,577 | * | 6/1995 | Kobayashi . |
| 5,484,155 | | 1/1996 | Dumontier et al. . |
| 5,501,459 | * | 3/1996 | Endo . |
| 5,518,243 | * | 5/1996 | Redman . |
| 5,658,207 | * | 8/1997 | Aizawa . |
| 5,720,674 | | 2/1998 | Galy . |
| 5,788,584 | * | 8/1998 | Parente . |
| 5,971,867 | | 10/1999 | Galy . |

FOREIGN PATENT DOCUMENTS

| | | |
|---|---|---|
| WO 93/19817 A1 | 10/1993 | (FR) . |
| WO 95/32765 | 12/1995 | (FR) . |

* cited by examiner

*Primary Examiner*—Sebastiano Passaniti
(74) *Attorney, Agent, or Firm*—Knobbe, Markens Olson & Bear LLP

(57) ABSTRACT

A golf club head (1) whose volume is delimited by a crown (3), a sole-plate (11), a belt (4), and a hitting surface (2), junctions between the belt (4) and the hitting surface (2) delimiting a heel (9) and a toe (10). The belt (4) comprises at least one arc-shaped portion (8, 32, 33, 34, 35) which forms a visible layer of-the belt (4), while extending along the belt (4) between the heel (9) and the tip (10), the arc-shaped portion (8, 32, 33, 34, 35) being a peripheral weight made of a high-density material.

2 Claims, 3 Drawing Sheets

GOLF CLUB HEAD

BACKGROUND OF THE INVENTION

This application is a continuation of Ser. No. 09/027,565 U.S. Pat. No. 5,971,867 filed Feb. 23, 1998 which is a continuation of Ser. No. 08/640,340 filed Apr. 30, 1996 U.S. Pat. No. 5,720,674.

The invention relates to the field of golf and, more particularly, to golf club heads.

Each club must enable a player to impart to the ball a long, precise trajectory. The distance traveled by the ball increases as the dynamic loft of the club head becomes greater, and trajectory accuracy improves as a function of head stability at the moment of impact on the ball. For this reason, manufacturers seek to improve the mechanical inertia of the heads.

Traditionally, golf club heads possessed homogeneous density; that is, they were made of solid wood or metal. These heads were difficult to use because of their low mechanical inertia. When a stroke was poorly aligned, the ball traveled substantially off-line.

Next appeared hollow heads made of metal or composite materials. These heads provided greater mechanical inertia for a given weight, thereby improving the golfers' performance.

However, despite the various prior art solutions to achieve optimal distribution of the weight of the head, many golfers still had difficulty hitting their shots properly.

Current heads do not make it possible to obtain ball trajectories that are simultaneously long and precise. In other words, present-day heads do not incorporate weight distribution capable of providing at the same time good dynamic loft and good stability upon impact.

SUMMARY OF THE INVENTION

The invention attempts to solve these problems by proposing a golf club head whose volume is delimited by the upper face, or crown, and a lower face, or sole plate, separated by a belt and a front, or hitting, surface, junction points of the belt and the hitting surface delimiting a heel and a toe.

According to the invention, the belt comprises at least one arc-shaped portion constituting a visible layer of the belt while extending along the belt between the heel and the toe, the arc-shaped portion being a peripheral mass made of a high-density material.

This structure makes it possible to increase maximally the mechanical inertia of the head as regards dynamic loft and stability upon impact. It follows, advantageously, that ball trajectories are both long and accurate.

According to a first embodiment, the head according to the invention comprises a single arc-shaped portion which is continuous along the belt from the heel to the toe. This structure facilitates manufacture and allows use of new, economical processes.

According to a first variant of the first embodiment, the head according to the invention comprises at least three parts, i.e., a first, upper part incorporating the crown, the hitting surface, and an upper portion of the belt; a lower part including the sole-plate and a lower portion of the belt; and an intermediate part constituted by the arc-shaped portion. This structure allows the use of materials of different kinds.

According to this first variant, the upper part, the lower part, and the intermediate part of the head are screwed together into one assembly.

This assembly method facilitates the attachment and detachment of the head. It advantageously allows adjustment and maintenance of the head.

According to a second variant of the first embodiment, the head comprises two parts, i.e., the arc-shaped portion and a block incorporating at least the crown, the belt, the sole-plate, and the hitting surface.

In this instance, it is easy to manufacture an impermeable block that can advantageously prevent the risks of dirt accumulation and heaviness of the head.

According to this second variant, the arc-shaped portion of the head is made of a metallic copper alloy, and the block is made of a titanium-based metal alloy. This arrangement makes it possible to optimize weight distribution and the inertial properties of the head, without impairing the impact-resistance thereof.

According to the second variant, the arc-shaped portion and the block are welded together. This structure produces a more pleasant sound on impact and, consequently, allows the golfer to remain focused.

According to the first and second variants of the first embodiment of the invention, the total weight of the head is between 185 and 205 grams, the weight of the arc-shaped portion is between 40 and 60 grams, and the volume of the head is between 250 and 270 $cm^3$.

These parameters impart to the head the size which is most reassuring to golfers, since it is neither too small nor too large and thus instills confidence in them.

According to a second embodiment, the head according to the invention comprises two arc-shaped portions. In this case, when considered together, the arc-shaped portions extend over at least 60% of the length of the belt, between the heel and the toe. This arrangement makes it possible to adjust weight distribution specifically for an individual golfer.

According to this second embodiment, the head comprises at least three parts, i.e., the two arc-shaped portions and a block incorporating at least the crown, the belt, the sole-plate, and the hitting surface. This structure allows selection of at least two different materials for manufacture of the head. Furthermore, the two arc-shaped portions may possess different densities. Accordingly, weight distribution specific to an individual golfer is further refined.

According to the second embodiment, the arc-shaped portions of the head are made of a metallic copper alloy and the block is made of a titanium-based metal alloy. In this case, the arc-shaped portions and the block are welded together, the total weight of the head is between 185 and 205 grams, the weight of each arc-shaped portion is between 16 and 34 grams, and the volume of the head is between 250 and 270 $cm^3$.

The structure disclosed by the second embodiment allows weight to be balanced in a manner suited to the game of an amateur player.

The invention also relates to a process for producing a head possessing the characteristics previously mentioned.

BRIEF DESCRIPTION OF THE DRAWINGS

Other features and advantages of the invention will be better understood from the following description provided with reference to the attached drawings illustrating, by means of examples, how the invention can be produced, and in which.

DETAILED DESCRIPTION

Figure 1:
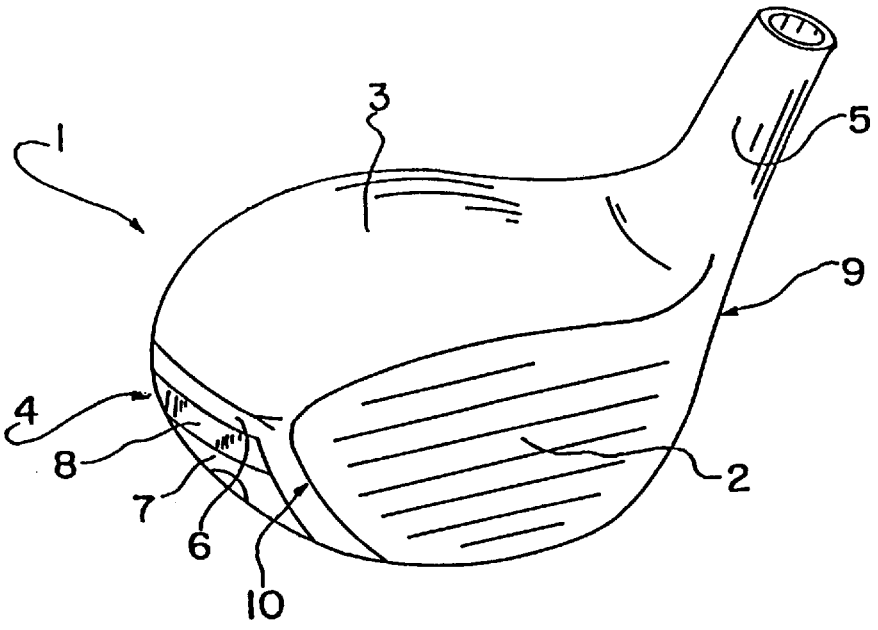
FIG. 1 is a perspective view of a head according to a first variant of a first embodiment of the invention.

According to a first variant of a first embodiment, a head 1 according to the invention is illustrated in perspective in FIG. 1, from an angle making it possible to distinguish a front, or hitting, surface 2, and upper face, or crown, 3, a belt 4, and a hosel 5. The belt 4 in turn comprises an upper portion 6 and a lower portion 7 separated by a strip 8 whose function will be explained below. Two ends of the hitting surface 2 form a heel 9 and a toe 10 at the spot where they connect with the belt 4.

Figure 2:
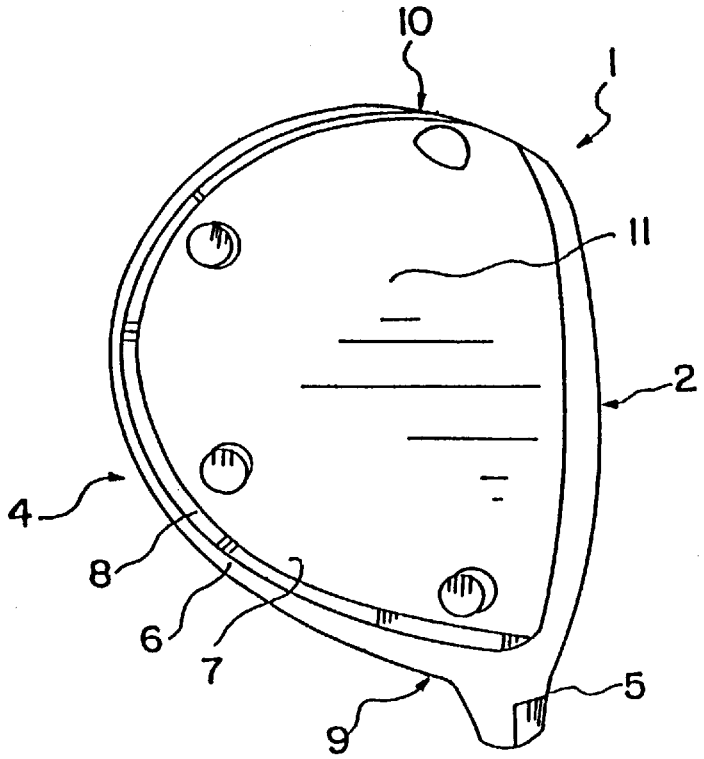
FIG. 2 is a perspective view from another angle of the head in FIG. 1.

A view of the head 1 from another angle as illustrated in FIG. 2 shows that a lower face, or sole-plate 11, is attached to the belt 4. The entire group of faces, including the hitting surface 2, the crown 3, the belt 4, and the sole-plate 11, form the jacket of a head 1, in this case the head of a metal-wood.

Figure 3:
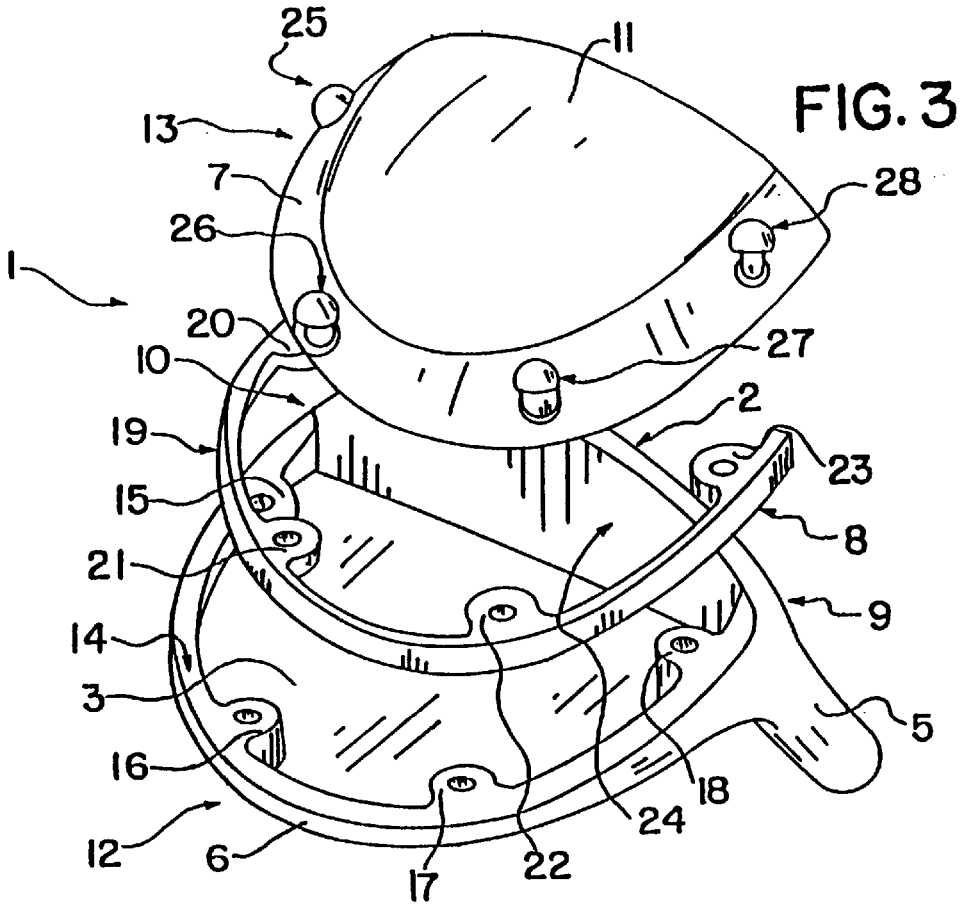
FIG. 3 shows a method for assembly of the head in FIGS. 1 and 2.

The head 1 is made of three main elements, as illustrated in an exploded view in FIG. 3:

- a first, or upper, part 12 formed by the combination of the crown 3, the hitting surface 2, the hosel 5, and the upper portion 6 of the belt 4;
- a second, or lower part 13 formed by the combination of the sole-plate 11 and the lower portion 7 of the center strip 4;
- an intermediate part formed by the peripheral strip 8.

The upper part 12 is preferably produced using casting techniques and a metal which may have a low density. For example, it is possible to use a titanium- or aluminum-based alloy. A steel could prove suitable, however, if the thickness of the faces is sufficiently thin, the goal being to produce a part 12 which is light in relation to the weight of the head 1.

The upper part 12 comprises means for connecting and positioning the peripheral strip 8, which take the form, for example, of a peripheral edge 14 of the upper portion 6 and eyes 15, 16, 17, 18 in the upper part 12, which are spaced along the peripheral edge 14.

The peripheral edge 14 may be produced directly by casting, or it may be machined. It functions as a surface supporting the peripheral strip 8, which serves as a weight extending along the peripheral edge 14, substantially from the heel 9 to the toe 10.

The peripheral strip, or weight, 8 preferably has a shape matching that of the peripheral edge 14 and of the eyes 15, 16, 17, 18. To this end, it comprises an arch 19 and projections 20, 21, 22, 23.

The weight 8 acts to add weight to the head 1 at the spot where it is located, i.e., substantially on the sides and to the rear of the head 1, but not on the front portion.

It is preferably made of a high-density material, e.g., an alloy containing copper, tin, or other metal. A steel weight 8 may be suitable if it has sufficient thickness.

The lower part 13 is preferably supported both on the weight 8 and on an inner side 24 of the hitting surface 2, so as to complete the jacket of the head 1. It is preferably made of a metal, in order to be both light and wear-resistant. In fact, it is the weight 8 which must govern the dynamic performance of the head 1, while the sole-plate 11 must resist friction on the ground.

Assembly means, for example screws 25, 26, 27, 28, are provided to hold together the upper part 12, the weight 8, and the lower part 13.

The screws 25, 26, 27, 28 extend simultaneously through the holes in the lower portion 7 of the belt 4 and through the holes in the projections 20, 21, 22, 23 belonging to the weight 8, before being housed in the eyes 15, 16, 17, 18 in the upper portion 12. Thus, when the screws 25, 26, 27, 28 are tightened, the head 1 is assembled and ready for use.

The structure of the head 1 makes it possible to position the weight 8 with great precision, in order to impart to the head 1 good mechanical properties. In fact, the lateral portions of the weight 8 adjoining the heel 9 and the toe 10 create a stabilizing effect during rotation of the head 1 in relation to a vertical axis at the moment of impact on a ball. As a result, ball trajectories are more accurate.

The rear portion of .the weight 8 allows the head 1 to pivot around a substantially horizontal axis, by virtue of an inertial phenomenon called dynamic loft. This phenomenon occurs as a result of club shaft flection during the swing and helps accentuate the original angle of inclination of the hitting surface 2. As a result, the balls climb higher into the air and travel farther.

Surprisingly, the continuous extension of the weight 8 along the belt 4 makes it possible to combine the effect of stabilization during rotation and the dynamic loft phenomenon in order to achieve optimal effectiveness.

The head 1 is thus advantageously accurate and capable of producing long strokes.

Moreover, this structure facilitates manufacture enormously as compared with traditional methods. In fact, it is not necessary to use complex cored molds comprising multiple parts, nor is it necessary to carry out welding, sanding, or heat treatment operations. Production costs and time are thus advantageously reduced.

The head 1 produced is a hollow volume that can be filled with a light material capable of damping vibrations generated by impacts with the ball. As one example, a plastic foam is highly effective.

Figure 4:
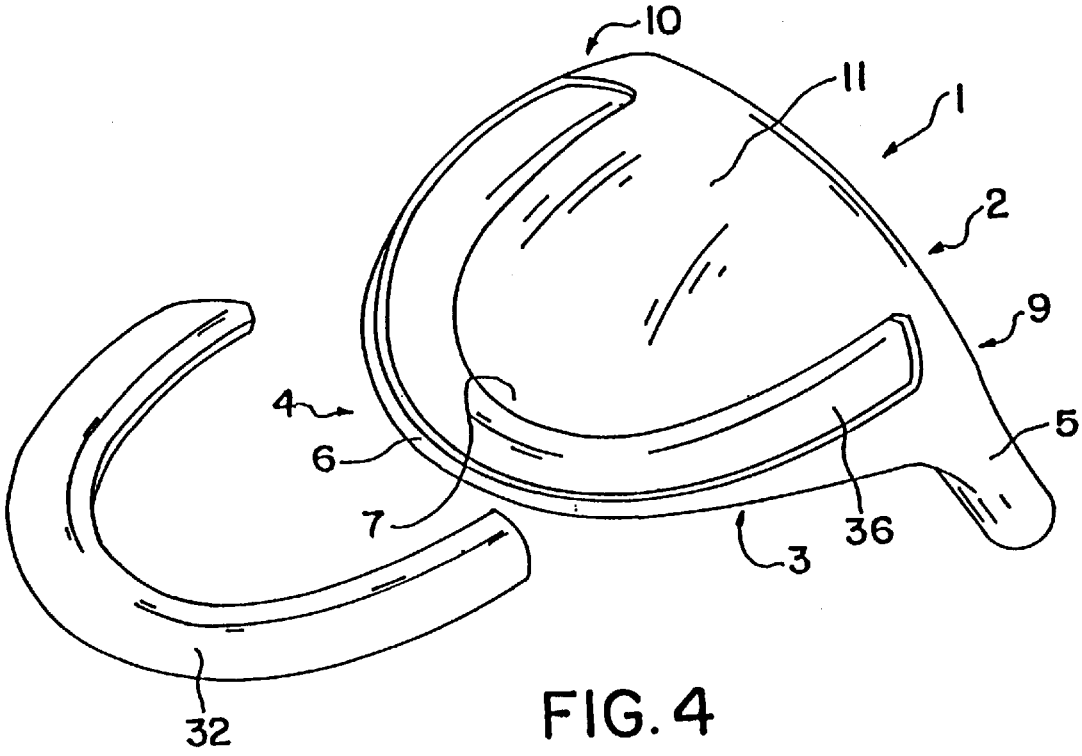
FIG. 4 is a second variant of the first embodiment.

The head 1 may be produced in accordance with other variants, such as that illustrated in FIG. 4.

For reasons of convenience, identical references are used to designate the same components.

The head 1 according to this variant comprises a block formed by assembling the hitting surface 2, the crown 3, the sole-plate 11, the belt 4, and the hosel 5. A recess 36 in the belt 4 and extending along the belt 4 substantially from the heel 9 to the toe 10 is provided to house an arc-shaped portion 32 made of a high-density material, the other parts of the head 1 being made of a material possessing lower density. For example, the portion 32 is made of a copper-based metal alloy, while the rest of the head 1 is made of a titanium-based metal alloy. The arc-shaped portion 32 is assembled with the block of the head 1 and is positioned in the recess 36, preferably in such a way that the volume of the recess 36 is entirely filled by the arc-shaped portion 32. As a result, the volume of the head 1 remains unchanged despite the presence of the arc-shaped portion 32. Any means of attaching the block and the arc-shaped portion 32 can be used. For example, the portion 32 can be welded to the block, with or without adding material in the form, for example, of a brazed seam, an electric spot weld, etc.

The two elements can also be glued, screwed together, riveted, etc.

Figure 5:
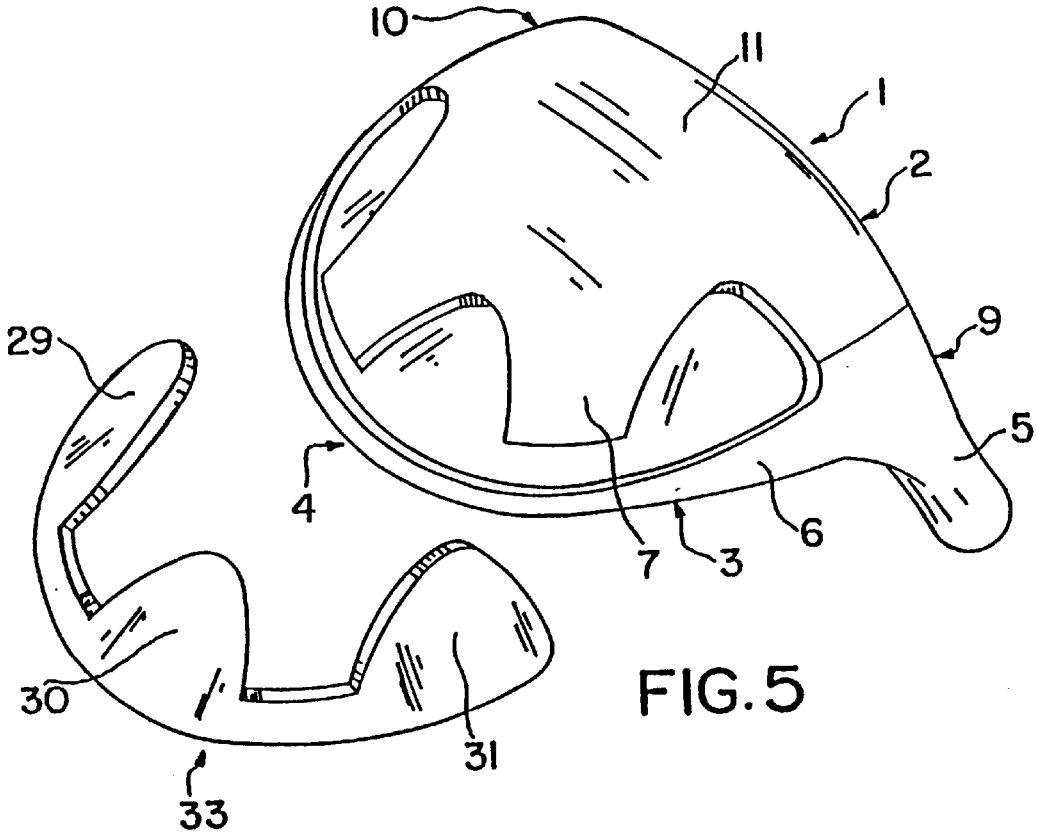
FIG. 5 is a view similar to FIG. 4.

Another variant of the head 1 according to this embodiment is illustrated in FIG. 5. It differs from the variant in FIG. 4 only by virtue of the fact that the shape of the arc-shaped portion and the housing recess do not have uniform width. The arc-shaped portion 33 incorporates three extensions 29, 30, 31 located respectively on the toe 10 side, to the rear, and on the heel 9 side. These extensions 29, 30, 31 of the arc-shaped portion 33 further improve the dynamic performance of the head 1 while increasing its total weight, but without exceeding the values which would make the golf swing difficult to perform.

Moreover, by virtue of their shape, these extensions 29, 30, 31 combine with the sole-plate 11 to facilitate the movement of the head 1 in the grass or in gravel. In fact, the shape of the sole-plate 11 corresponds to the areas of heaviest friction and wear. Now, the harder material used to manufacture the sole-plate 11 is relatively expensive. Consequently, savings are achieved by combining the extensions 29, 30, 31 of the arc-shaped portion 33 with the shape of the sole-plate 11.

Figure 6:
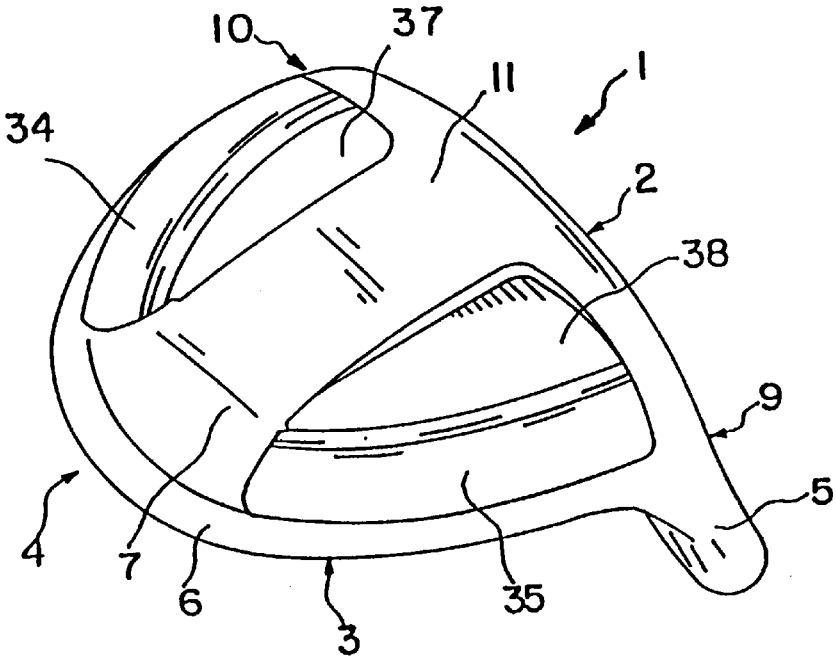
FIG. 6 is a perspective view of a head according to a second embodiment of the invention.

FIG. 6 illustrates a second embodiment of a head 1 according to the invention. This head 1 comprises two arc-shaped portions 34, 35 intended to be made integral with a block incorporating, in particular, the hitting surface 2, the sole-plate 11, the crown 3, the peripheral strip 4, and the hosel 5. In this instance, the arc-shaped portions 34, 35 partially fill cavities 37, 38 in the head 1 and are attached to the head 1, as was previously described.

The cavities 37, 38 are open, but do not prevent the block from retaining a volume substantially identical to that of the variants of the previous embodiment.

On the other hand, the shape of the arc-shaped portions 34, 35 of the cavities 37, 38 and of the sole-plate 11 are combined so as to ensure simultaneously good dynamic equilibrium of the head 1 and the enhanced capacity to describe a line tangent to the ground is during the swing.

In all of the variants and according to all of the embodiments of the invention, the head is distinguished from all other existing club heads on the market by the fact that, for a given volume, inertial properties are enhanced, since they are greater in magnitude.

Knowing that the golf market requires wood-type heads having a volume of approximately 260 $cm^3$, the invention can be compared to existing heads using the table below, in which:

each volume is given in $cm^3$,

13 is the mechanical inertia of the head in relation to a vertical axis passing through the center of gravity when the head 1 is in the ball-address position, in $g/mm^2$, weights are expressed in grams.

| | VOLUME | 13 | WEIGHT |
|---|---|---|---|
| steel head currently sold | 220 | 280 | 185–205 |
| titanium head currently sold | 260 | 290 to 310 | 185–205 |
| head according to the invention | 260 | 310 to 340 | 185–205 |

Preferably, the arc-shaped portion 8, 32, 33 weighs approximately 50 grams and is between 40 and 60 grams. The arc-shaped portions 34, 35 preferably weigh between 16 and 34 grams.

Furthermore, this type of construction can be used for all of the heads in a set of clubs.

What is claimed is:

1. A wood-type golf club head that includes a main body comprised of an upper surface, a strike surface for striking a golf ball, a weight comprised of a first material, and a lower surface, said main body defining a heel portion, a toe portion and a rear portion, said lower surface comprising a sole plate and at least a portion of said weight, said sole plate being positioned so as to cover areas of heaviest friction and wear on said lower surface when said club head is used to strike a golf ball and comprised of a second material that is harder and less dense than said first material, said portion of said weight comprising extensions positioned on said heel portion, said toe portion and said rear portion so as to cover areas of the least amount of friction and wear on said lower surface when said club head is used to strike said golf ball.

2. The golf club of claim 1, wherein said first material is a copper metal alloy.

* * * * *